US010829888B1

(12) United States Patent
Duncan-Carnesciali

(10) Patent No.: US 10,829,888 B1
(45) Date of Patent: Nov. 10, 2020

(54) SACHET FOR PACKAGING, WASHING AND DRYING COSMETIC SPONGES

(71) Applicant: Joanne Duncan-Carnesciali, Montepulciano (IT)

(72) Inventor: Joanne Duncan-Carnesciali, Montepulciano (IT)

( * ) Notice: Subject to any disclaimer, the term of this patent is extended or adjusted under 35 U.S.C. 154(b) by 0 days.

(21) Appl. No.: 16/822,681

(22) Filed: Mar. 18, 2020

Related U.S. Application Data

(63) Continuation-in-part of application No. 15/692,782, filed on Aug. 31, 2017.

(51) Int. Cl.
*D06F 95/00* (2006.01)
*A45D 34/04* (2006.01)

(52) U.S. Cl.
CPC ..... *D06F 95/006* (2013.01); *A45D 34/04* (2013.01); *A45D 2200/1018* (2013.01)

(58) Field of Classification Search
None
See application file for complete search history.

(56) References Cited

U.S. PATENT DOCUMENTS

| | | | | |
|---|---|---|---|---|
| 5,320,429 | A | 6/1994 | Toyosawa | |
| 7,056,023 | B2 | 6/2006 | Heidel | |
| 2002/0082188 | A1* | 6/2002 | Baker | A47L 23/05 510/475 |
| 2019/0062988 | A1* | 2/2019 | Duncan-Carnesciali | A61K 8/0208 |

* cited by examiner

*Primary Examiner* — Nicole Blan
(74) *Attorney, Agent, or Firm* — Walter A. Rodgers

(57) ABSTRACT

A sachet used for washing cosmetic sponges. The sachet is made of a permeable material so water may pass freely into and out of the sachet. The sachet includes an opening forming an entrance into the sachet and further includes a connector operable to open and close the opening and thereby open and close the entrance. The sachet material includes a pair of spaced fabric layers interconnected by monofilament fibers and treated with an antimicrobial/bacterial agent.

5 Claims, 3 Drawing Sheets

SACHET FOR PACKAGING, WASHING AND DRYING COSMETIC SPONGES

This a continuation-in part of application Ser. No. 15/692,782 filed Aug. 31, 2017.

BACKGROUND OF THE INVENTION

This invention relates to the packaging and cleaning of non-disposable cosmetic sponges, and more particularly, to an environmentally-sustainable anti-microbial packaging system for cosmetic sponges that eliminates single-use plastic packaging in addition to reducing the likelihood of bacterial and fungal contamination associated with the use of non-disposable cosmetic sponges.

Cosmetics are used to enhance the appearance of the body. Many cosmetics are designed for use by applying them to a person's face. Cosmetics that are meant to be used on the face and eye area are usually applied with a brush, a cosmetic sponge or one's fingertips. When non-disposable cosmetic sponges are used, they must be washed and dried after use. Currently, cosmetic sponges are packaged in plastic and individually hand washed, which is time consuming and requires excessive use of water and cleaning solution but still does not thoroughly clean the sponges. This current approach to washing cosmetic sponges poses significant health risk to the consumer if not dried and properly maintained and also encourages the growth of microorganisms.

A recent study undertaken at Ashton University, in the city of Birmingham, United Kingdom, highlighted that cosmetic sponges, also known as beauty blenders, are recent additions to the cosmetic market and are applicators rather than a cosmetic product. They are small, synthetic sponges used to blend liquid products such as foundation and concealer into the skin and, therefore, have regular contact with the hands and face. A recent article revealed that in 2016 more than 6.5 million beauty blenders were sold (Shah 2016). Improper use of cosmetic sponges leading to contamination allows bacteria and fungi to grow, thus posing a risk to the consumer. The study further highlighted that beauty blenders had the highest rate of fungal contamination. Furthermore, questionnaires completed by study participants revealed that 93% of beauty blenders had not been cleaned and 64% had been dropped on the floor and continued to be used. Enterobacteriaceae were also detected in all product types, with particularly high numbers observed in beauty blenders. The investigators highlighted that "further advice and education are needed on the use and maintenance of these products to avoid self-contamination of potentially harmful microorganisms."

The study further revealed that beauty blenders have only been recently introduced as an application product and limited information is available on how best to use or clean them. The results of this study established that non-disposable cosmetic sponges, also known as beauty blenders, carried the highest bacterial load during use and more than a quarter were contaminated with enterobacteriaceae. *Acinetobacter ursingii* was also detected in this product type, a gram-negative coccobacillus known as an important opportunistic pathogen known for causing nosocomial infections. Beauty blenders could pose a significant risk to consumers as their product design allows microorganisms to accumulate. Beauty blenders can be cleaned with warm soapy water thereby encouraging microbial proliferation if not dried.

Textiles treated with antimicrobial agents such as quaternary ammonium compounds (QACs), triclosan, metals and metallic salts (silver), chitosan and natural-based antimicrobial agents have been shown to be effective in inhibiting the growth of gram-positive and gram-negative bacteria such as, *Escherichia coli, P. aeruginosa, Candida albicans, Candida parapsilosis, Staphylococcus aureus, Vibrio cholera, Bacillus subtilis, Klebsiella pneumonia Salmonella enterica* and *Acinetobacter baummanii.*

The above highlights the need for an environmentally-sustainable packaging system for cosmetic sponges that eliminates single-use plastic packaging and solves the problem of how to package, wash, dry and store reusable cosmetic sponges as well as the problem of bacterial and fungal contamination associated with improperly packaged and laundered cosmetic sponges.

SUMMARY OF THE INVENTION

One feature of the present invention is the use of a sachet to package and store cosmetic sponges, where the sachet is made of a permeable material and includes a connector operable to open and close an opening forming an entrance into the sachet for receiving the cosmetic sponge(s). The sachet is manufactured of an environmentally-sustainable multiple layer structure with a top and bottom layer and an intermediate layer of microfilament or other sustainable textile. Also, a antimicrobial agent is dispersed throughout the sachet packaging material.

Another feature of the invention is the use of the sachet for laundering the reusable cosmetic sponges.

The final feature of this invention is that the sachet is also utilized as a makeup/cosmetics case for makeup tools frequently used on the skin.

DETAILED DESCRIPTION OF THE INVENTION

This invention includes a sachet for packaging, washing, drying and storing cosmetic sponges. The sachet for cosmetic sponges solves the problem of single-use plastic packaging in circumstances where cosmetic sponges are sold in bulk by venders and the frequent and time-consuming manual washing of individual cosmetic sponges. Further, the sachet packaging is manufactured using a three-dimensional spacer mesh treated with an antimicrobial agent which inhibits the growth of bacteria and fungus on the sachet as well as the cosmetic sponges. The sachet allows the user to wash and dry cosmetic sponges in the same manner as one washes ordinary laundry thereby reducing time and effort over traditional handwashing. The invention further provides a means for the user to store and carry the cosmetic sponges in a sanitary manner while travelling.

Figure 1:
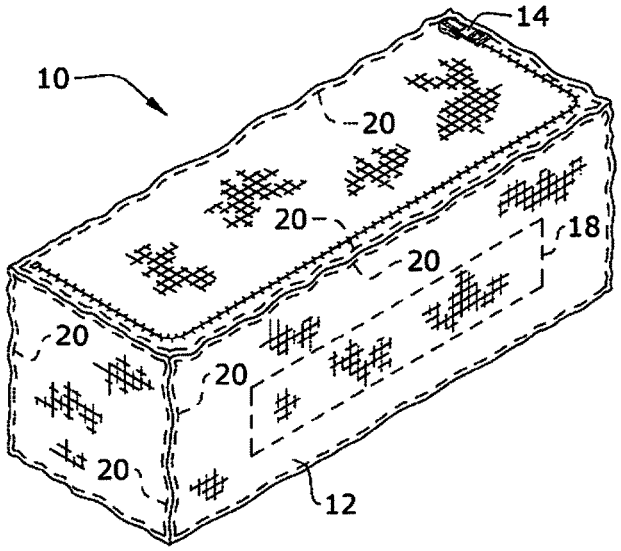
FIG. 1 is a perspective view of an embodiment of the present invention shown in use.
Figure 2:
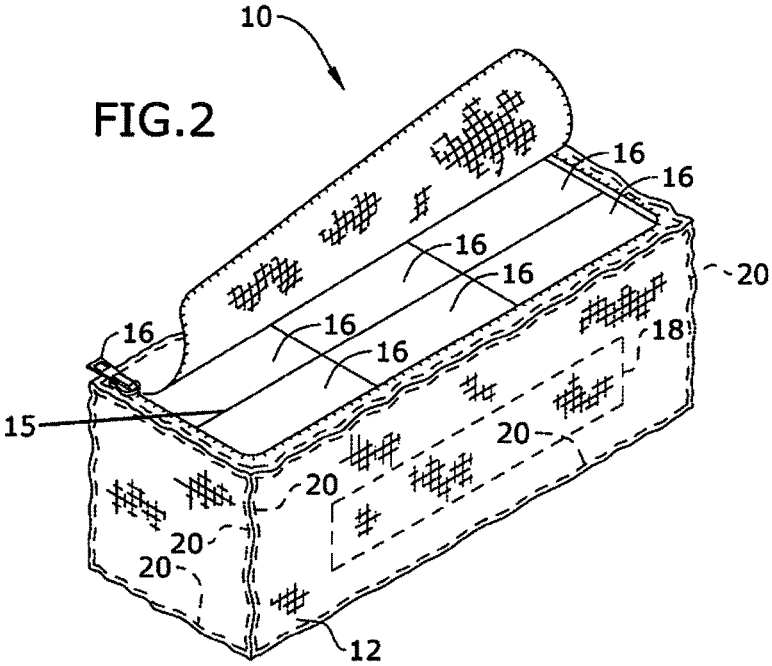
FIG. 2 is a perspective of an embodiment of the present invention in an opened position.
Figure 3:
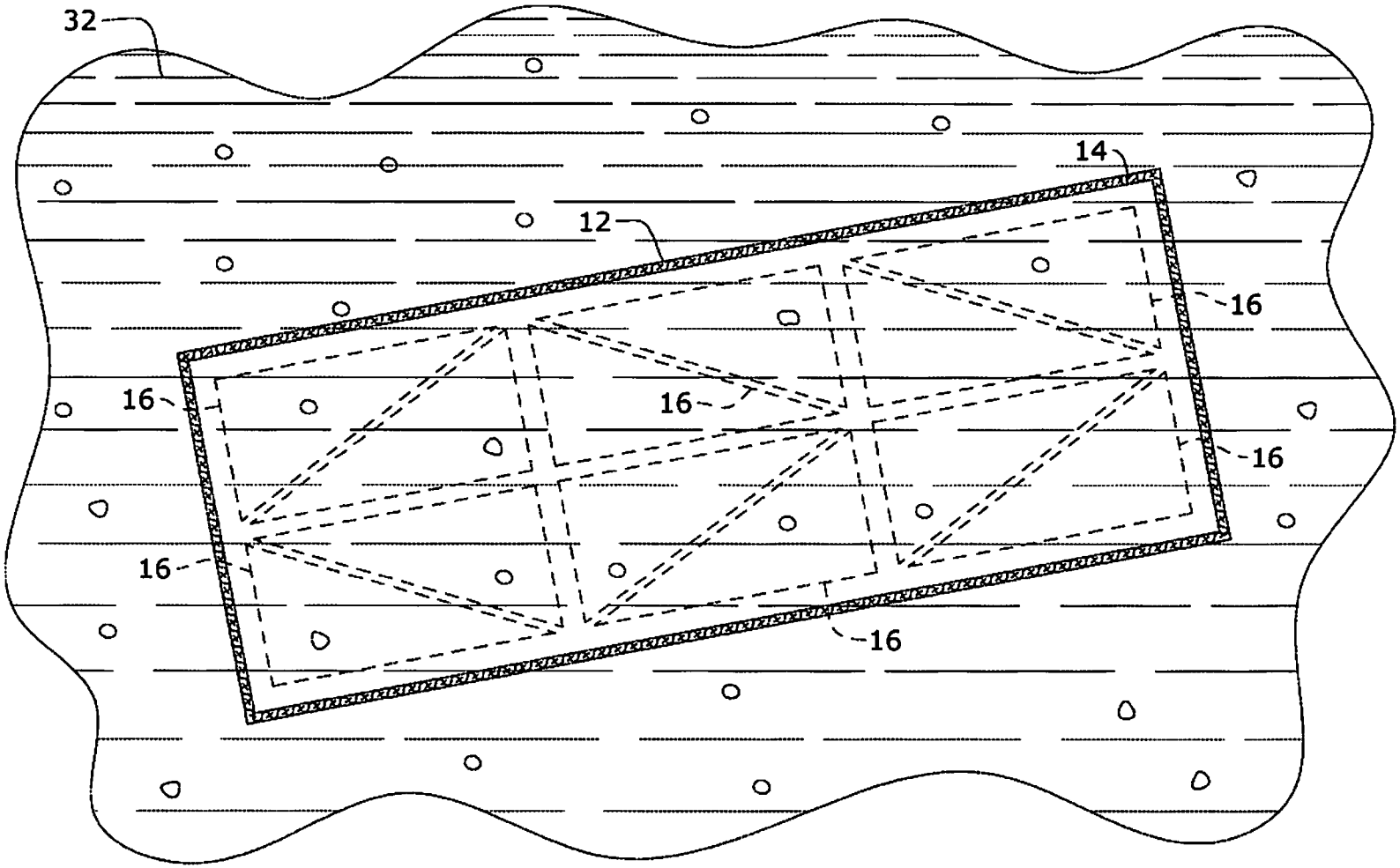
FIG. 3 is a section view of an embodiment of the present invention being washed.

Referring to FIGS. 1 through 3, sachet 10 is used for packaging, washing and storing cosmetic sponges 16. Sachet 10 is made of a three-dimensional permeable mesh treated with an antimicrobial agent 12 so soapy water 32 may pass freely into and out of sachet 10. Sachet 10 includes an opening forming an entrance into the sachet 10 and further includes connector 14 operable to open and close the opening.

The permeable material forming the sachet includes a soft durable soft machine washable mesh. For example, the sachet 10 is made of a woven fabric, a mesh material and the like. The woven fabric is connected together by stitching 20. In certain embodiments a logo may be stitched to or printed on logo area 18 of the outer surface of the sachet 10.

Sachet 10 also includes a rectangular shape. In such embodiments, connector 14 may be a zipper used to open and close the entrance. A user opens the sachet 10 using the zipper, places the cosmetic sponges 16 into the sachet 10 and then closes the sachet using the zipper. The sachet is placed into a washing machine that includes soapy water 32. The rectangular shaped sachet 10 is also used as packaging unit for manufacturers and venders of cosmetic sponges in bulk.

The washing machine is a standard electrical washing machine which uses water and detergent to wash and clean the cosmetic sponges 16 within sachet 10.

In certain embodiments, sachet 10 includes dividers 15. Dividers 15 are disposed within the sachet 10 and form a plurality of compartments within the sachet 10. Each compartment includes a single cosmetic sponge 16 disposed therein or multiple sponges 16 each having an inclined plane disposed in face contacting relation.

Figure 4:
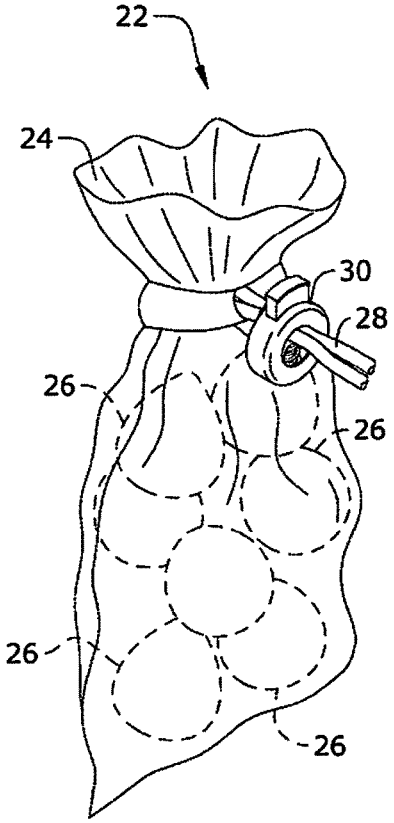
FIG. 4 is a perspective view of an embodiment of the present invention.

As illustrated in the FIG. 4, sachet 22 may also include a bag shape. Sachet 22 is made of a permeable material 24 and includes a connector 28, 30. Connector 28, 30 includes an elastic cord 28 and a cord stop 30. Elastic cord 28 is loosened using the cord stop 30 to open the entrance of the sachet 22. The entrance of the sachet 22 is closed by tightening the elastic cord 28 using the cord stop 30 and sachet 22 is then placed in the washing machine to be washed.

A method of cleaning cosmetic sponges includes the following steps: opening the entrance of the sachet via the connector; placing a plurality of used cosmetic sponges through the entrance and into the sachet; closing the entrance of the sachet via the connector; pretreating the sponges as well as the exterior of the sachet with a makeup stain remover; placing the sachet into a washing machine; adding detergent to the washing machine; and powering the washing machine. The used cosmetic sponges include a plurality of sponges each having a layer of makeup disposed on the surface. Once the cosmetic sponges are washed, the sachet and the sponges are put in to a dryer to dry.

Figure 5:
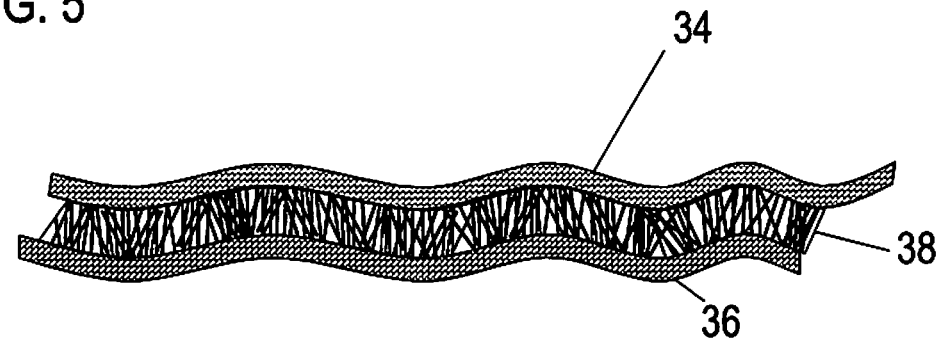
FIG. 5 depicts details of the sachet fabric material.

According to a feature of this invention, sachet 10 is formed of a three-dimensional manufactured textile structure. As shown in FIG. 5, the mesh material of sachet 10 includes top fabric layer 34 and bottom fabric layer 36. Multiple compression resistant polyester microfilaments 38 are disposed between and interconnect top layer 34 and bottom layer 36. Monofilament polyester fibers 38 are produced with sufficient stiffness to maintain separation of outer layers 34 and 36. Also, as shown in FIG. 5, fibers 38 extend between layers 34 and 36 at varying angles whereby each fiber 38 crosses one or more of the other fibers. By this means, fluid is allowed to freely pass between the layers during washing of cosmetic sponges within sachet 10 and permits hot air to flow through the layers of sachet 10 during drying of the cosmetic sponges.

In addition, since makeup sponges are highly receptive to bacterial and fungal activity, an antimicrobial agent is added to the material of sachet 10.

The advantages of the multilayer sachet fabric include its antimicrobial/bacterial properties, high air permeability and breathability, durability, recyclability, heat and moisture transfer.

The invention claimed is:

1. A sachet for packaging, washing and drying cosmetic sponges comprising:

said sachet made of a permeable material, said permeable material comprising spaced top and bottom layers, monofilament fibers being compression resistant disposed between and interconnecting said layers, said monofilament fibers extending at varying angles between said layers, each of said fibers crossing one or more of the other fibers, and said material being infused with an antimicrobial agent.

2. The sachet according to claim 1 wherein said sachet comprises a quadrilateral shape with an opening through which said sponges are placed.

3. The sachet according to claim 2 wherein said sponges comprise an inclined plane and the planes of two of said sponges are disposed in face contacting relation.

4. The sachet according to claim 1 wherein said sachet is adaptable for washing in a washing machine and drying in an electric or gas dryer.

5. The sachet according to claim 1 wherein said monofilament fibers comprise polyester.

* * * * *